US012137766B1

(12) United States Patent
Andrews

(10) Patent No.: US 12,137,766 B1
(45) Date of Patent: Nov. 12, 2024

(54) HELMET WITH ADJUSTABLE REAR HAIR SUPPORT

(71) Applicant: Arielle Andrews, Washington, DC (US)

(72) Inventor: Arielle Andrews, Washington, DC (US)

( * ) Notice: Subject to any disclaimer, the term of this patent is extended or adjusted under 35 U.S.C. 154(b) by 125 days.

(21) Appl. No.: 18/088,527

(22) Filed: Dec. 24, 2022

(51) Int. Cl.
*A42B 3/08* (2006.01)
*A42B 3/04* (2006.01)

(52) U.S. Cl.
CPC ..... *A42B 3/08* (2013.01); *A42B 3/0406* (2013.01)

(58) Field of Classification Search
CPC .. A42B 3/32; A42B 3/324; A42B 3/08; A42B 3/085; A42B 3/0406; A42B 3/14–147; A42B 1/0181; A42B 1/0182; A42B 1/0186; A42B 1/0187; G02B 27/01; G02B 27/0176
See application file for complete search history.

(56) References Cited

U.S. PATENT DOCUMENTS

| | | | | |
|---|---|---|---|---|
| 10,531,698 | B2 | 1/2020 | Stolker | |
| 11,969,043 | B2 * | 4/2024 | Brose | A42B 3/14 |
| 2009/0320187 | A1 | 12/2009 | Petzl et al. | |
| 2017/0143070 | A1 | 5/2017 | Cram et al. | |
| 2022/0346485 | A1 * | 11/2022 | Jatyani | A42B 3/125 |
| 2023/0380535 | A1 * | 11/2023 | Maloney | A42B 3/065 |
| 2024/0143029 | A1 * | 5/2024 | Weiss | G02B 27/0176 |

* cited by examiner

*Primary Examiner* — Katherine M Moran
(74) *Attorney, Agent, or Firm* — Donald J. Ersler

(57) ABSTRACT

A helmet with adjustable rear hair support preferably includes a helmet portion, an adjustable chin strap, an adjustable head mechanism and an adjustable hair support. One end of the adjustable chin strap is sized to receive a chin and opposing ends of the chin strap are secured to opposing sides of an inside rim of the helmet portion. The adjustable head mechanism includes a left head strap, a right head strap, a head strap base and a head ratchet mechanism. Ends of the left and right head straps are secured to opposing sides of the inside rim of the helmet portion. The adjustable hair support preferably includes left and right pivot bases attached to the inside rim of the helmet portion. A hair support bar is pivotally engaged with the left and right pivot bases with left and right pivoting ratchet mechanisms.

13 Claims, 10 Drawing Sheets

HELMET WITH ADJUSTABLE REAR HAIR SUPPORT

BACKGROUND OF THE INVENTION

1. Field of the Invention

The present invention relates generally to head protection and more specifically to a helmet with adjustable rear hair support, which allows the support to be adjusted for different volumes of hair.

2. Discussion of the Prior Art

Helmets, such as bicycle helmets are not traditionally designed to accommodate riders with thick or curly hair. Those riders are often forced to buy helmets that are large enough to cover their hair, while compromising the secure fit required to adequately protect their skulls in an accident. Other riders spend countless hours styling their hair, usually in braids or twists, to adequately fit under the helmet. And many more avoid the helmet-or sport-all together for fear of hair damage, breakage, or other incompatibilities. Different individuals have different volumes of hair. A 2019 study found that Black and Latinx riders were the least likely to wear helmets. This inclusive headgear invention seeks to remedy these issues and encourage bicycle riding participation. Patent publication no. 2009/0320187 to Petzl et al. discloses a protective helmet for hair worn in a pony tail. Patent publication no. 2017/0143070 to Cram et al. discloses a helmet fit adjustment system with releasable hair aperture. Patent no. 10531698 to Stolker discloses a soft athletic helmet and rear closure mechanism.

Accordingly, there is a clearly felt need in the art for a helmet with adjustable rear hair support, which allows the support to be adjusted for different volumes of hair.

SUMMARY OF THE INVENTION

The present invention provides a helmet with adjustable rear hair support, which allows the hair support to be adjusted for different volumes of hair. A helmet with adjustable rear hair support (helmet with hair support) preferably includes a helmet portion, an adjustable chin strap, an adjustable head mechanism and an adjustable hair support. The helmet portion preferably includes an outer shell, an inner shell and a helmet foam insert. The foam helmet insert is retained between the inner and outer shells with any assembly method, such as applying a bonding agent. One end of the adjustable chin strap is sized to receive a chin and opposing ends of the chin strap are secured to opposing sides of an inside rim of the helmet portion. Adjustable chin straps are well known in the art and need not be explained in further detail. The adjustable head mechanism includes a left head strap, a right head strap, a head strap base and a head ratchet mechanism. The head strap base includes ratchet opening for receiving the head ratchet mechanism. One end of the left head strap includes a left rachet loop and one end of the right head strap includes a right ratchet loop. The ratchet mechanism is inserted through the left rachet loop, right ratchet loop and the ratchet opening. The ratchet mechanism is retained in the ratchet opening. Opposing ends of the left and right head straps are secured to opposing sides of an inside rim of the helmet portion.

The adjustable hair support preferably includes a left pivot base, a right pivot base, a hair support bar, a left pivoting ratchet mechanism and a right pivoting ratchet mechanism. One end of the left pivot base includes a left attachment surface and an opposing end includes a left pivot hole. One end of the right pivot base includes a right attachment surface and an opposing end includes a right pivot hole. The hair support bar has a substantial U-shape. The hair support bar includes a left pivot ear, a right pivot ear and a hair support base.

The right and left ratchet mechanisms each include a base ratchet member, a support ratchet member, an anchor plate and a fastener. The base ratchet member preferably includes a tubular projection, a fastener pole and a base plate. The tubular projection extends outward from a front of the base plate. A pair of ratchet projections extend from opposing ends and outward from the front of the base plate. The fastener pole is concentric with the tubular projection and extends outward from the front of the base plate. A hole is formed in the fastener pole to receive a self-tapping screw.

The support ratchet member preferably includes a support base plate and two pin projections. The two pin projections extend outward from opposing ends and a front the support base plate. A center hole is formed through the base plate. A pair of ratchet teeth are formed on opposing ends of the support base plate and perpendicular to the two pin projections. A curved opening is formed through the support base plate and behind each set of ratchet teeth. The ratchet teeth are sized to receive one of the pair of ratchet projections of the base ratchet member. The curved opening is formed behind each set of ratchet teeth to allow the set of ratchet teeth to deflect inward into the support base plate to allow the support ratchet member to be rotated relative to the base ratchet member. The anchor plate includes a pin boss that extends from a rear thereof. A pin bore is formed in a rear of the pin boss to provide clearance for the fastener pole. A fastener hole is formed through the pin boss to receive the fastener. A plurality of cavities are preferably formed around the pin bore.

The helmet with hair support is preferably assembled in the following manner. The outer shell is attached to a top of the foam helmet insert and the inner shell is attached to a bottom of the foam helmet insert by applying a bonding agent to form the helmet portion. Opposing ends of the chin strap are secured to opposing sides of an inside rim of the helmet portion. Opposing ends of the left and right head straps of the adjustable head mechanism are secured to opposing sides of an inside rim of the helmet portion. The left attachment surface of the left pivot base is attached to a left side of the inside rim of the helmet portion with a bonding substance or the like. The right attachment surface of the right pivot base is attached to a right side of the inside rim of the helmet portion with a bonding substance or the like.

A support bore is formed in the left and right pivot bases to receive the base plate of the left and right support rachet members. A tube bore is formed in the left and right pivot ears to receive the tubular projection of the left and right support ratchet members. A pole hole is formed through a bottom of the tube bore to receive the fastener pole of the left and support ratchet members. An anchor bore is formed in an inside surface of the left and right pivot ears to receive the anchor plate. The left and right support ratchet members are inserted into the right and left pivot ears. The left and right anchor plates are inserted into the left and right anchor bores. The left base ratchet member is inserted into the left pivot hole of the left pivot base. The left base ratchet member is secured to the left pivot base. The right base ratchet member is inserted into the right pivot hole of right pivot base. The right base ratchet member is secured to the right pivot base. A left fastener is inserted through the left anchor plate and threaded into the left fastener pole of the left base rachet member. A right fastener is inserted through right anchor plate and threaded into the right fastener pole of the right base ratchet member. The hair support bar may be angularly adjusted relative to a bottom of the helmet rim.

Accordingly, it is an object of the present invention to provide a helmet with adjustable rear hair support, which allows the support to be adjusted for different volumes of hair.

These and additional objects, advantages, features and benefits of the present invention will become apparent from the following specification.

DETAILED DESCRIPTION OF THE PREFERRED EMBODIMENTS

Figure 1:
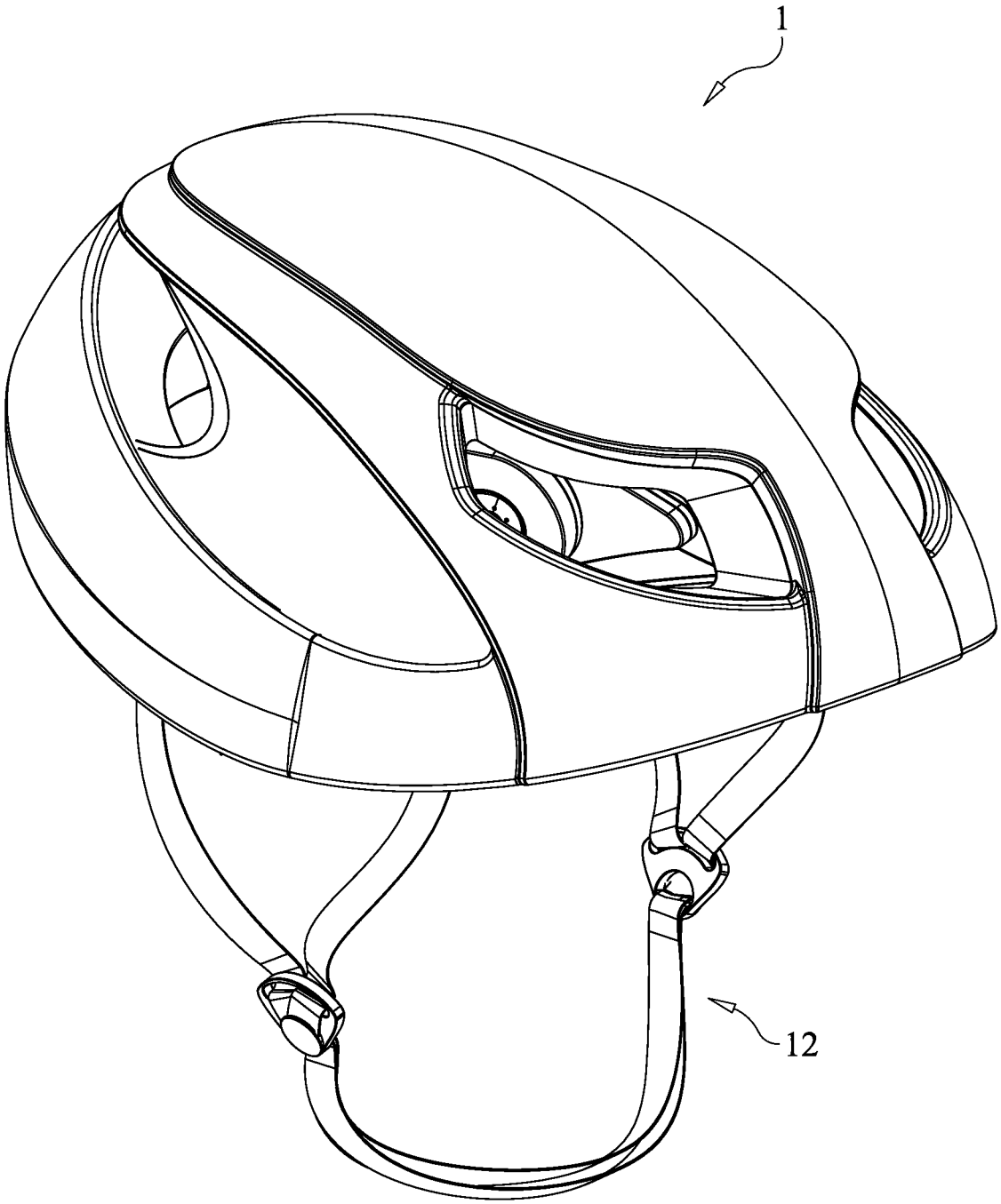
FIG. 1 is a top perspective view of a helmet with hair support in accordance with the present invention.
Figure 2:
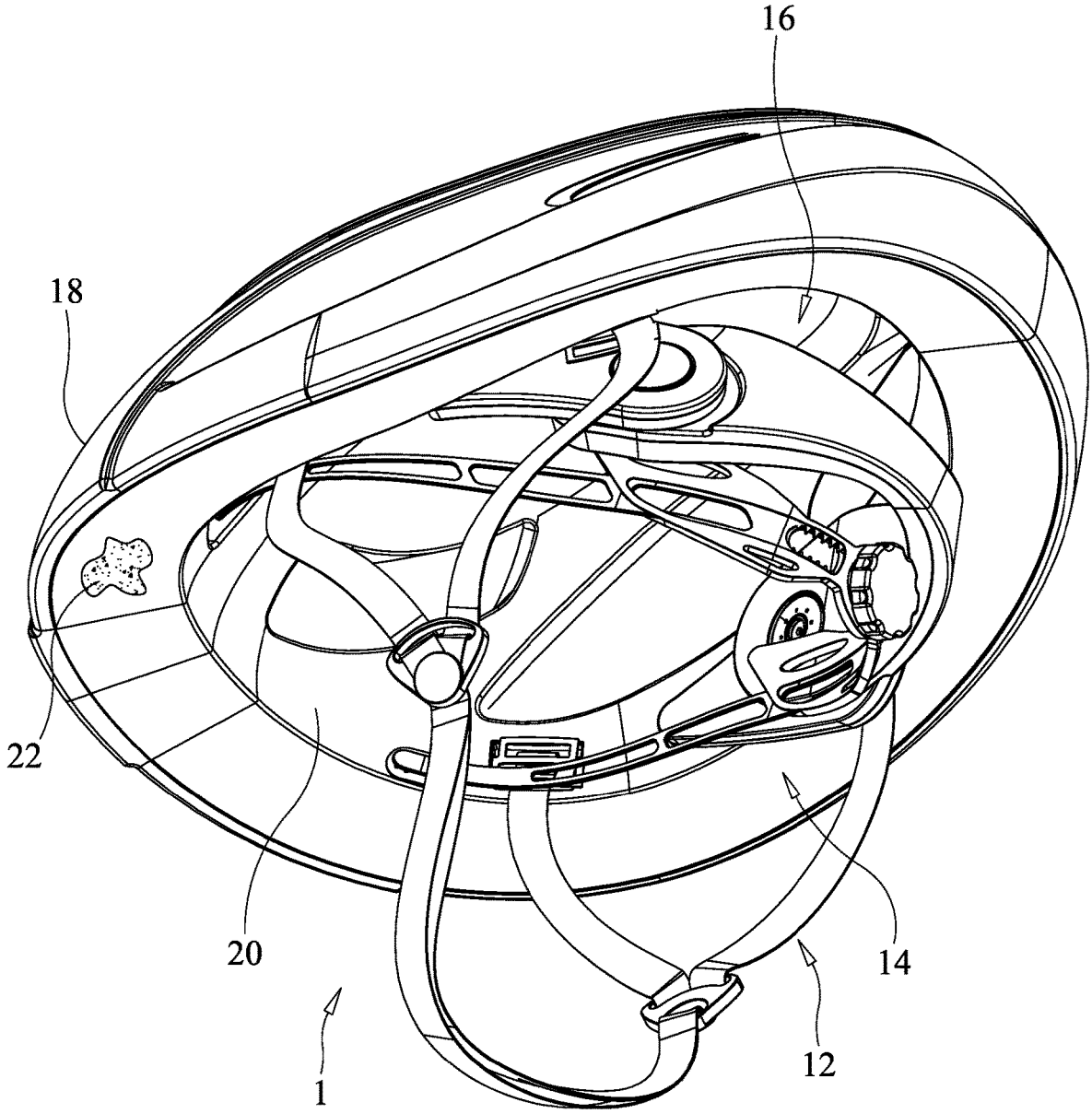
FIG. 2 is a bottom perspective view of a helmet with hair support in accordance with the present invention.
Figure 3:
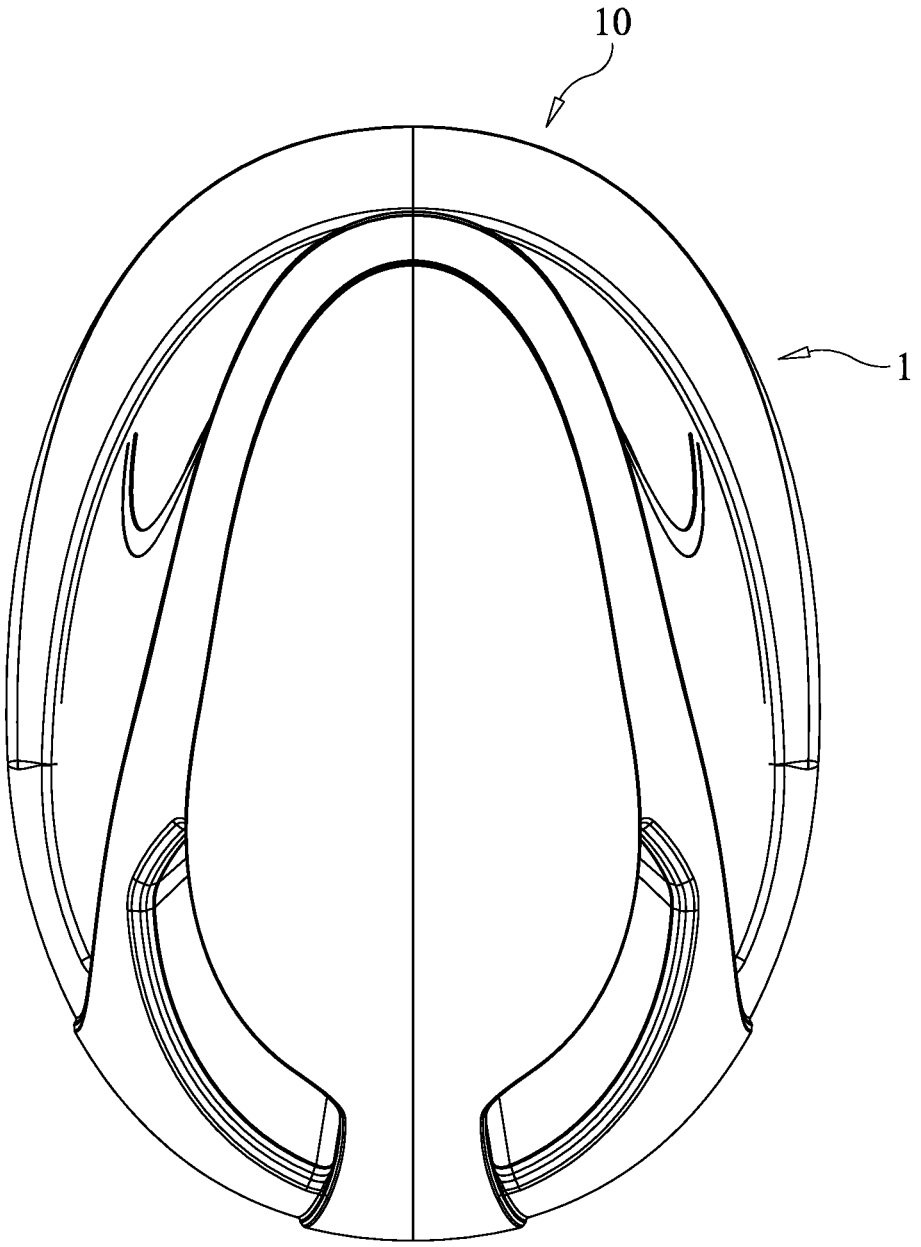
FIG. 3 is a top view of a helmet with hair support in accordance with the present invention.
Figure 4:
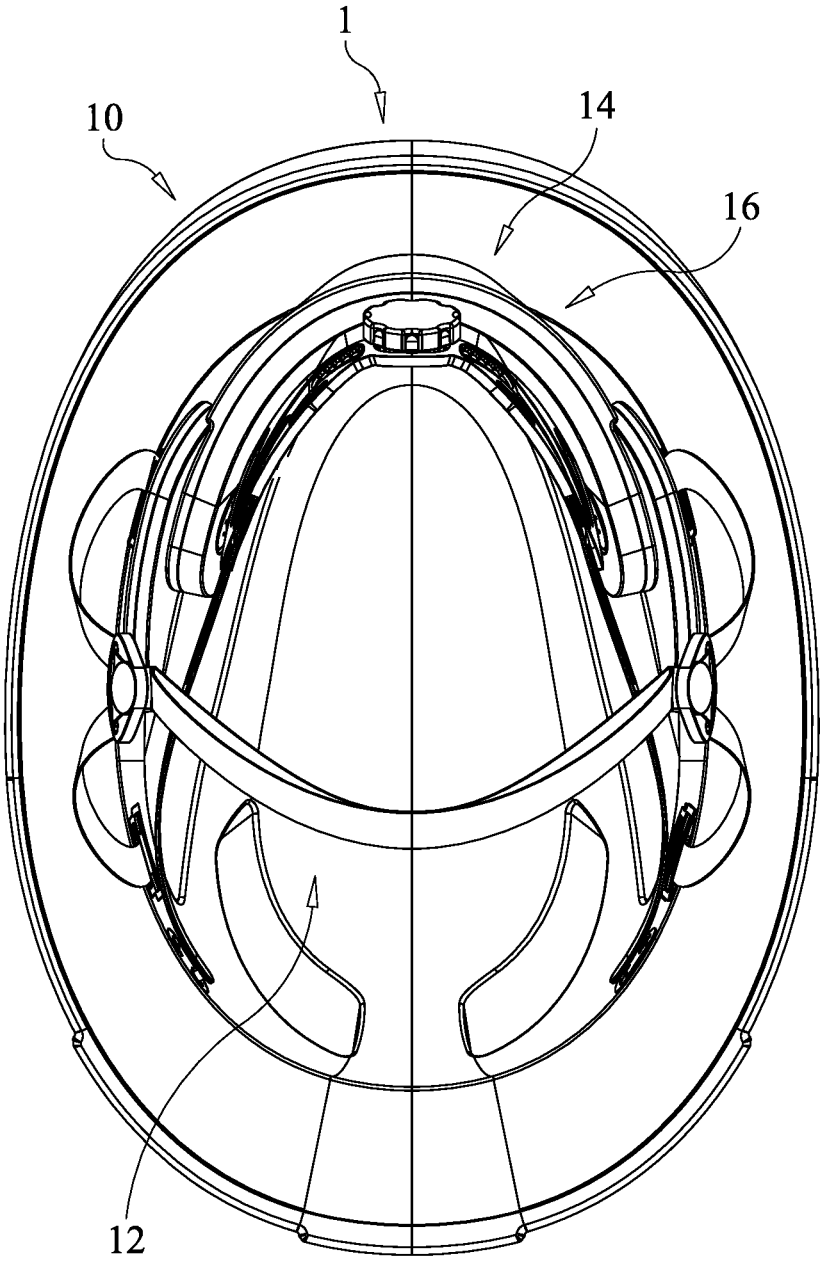
FIG. 4 is a bottom view of a helmet with hair support in accordance with the present invention.
Figure 5:
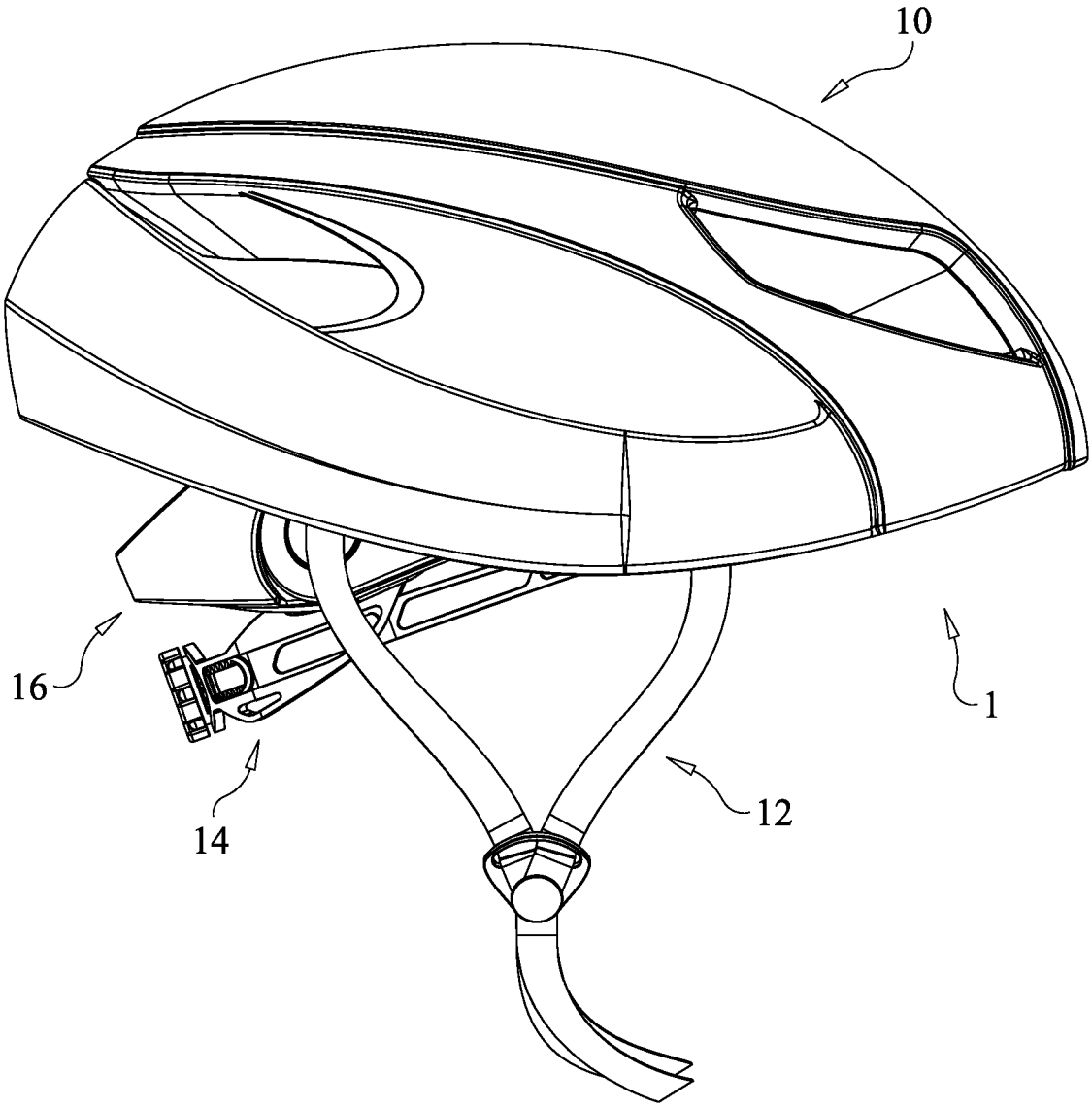
FIG. 5 is a right side view of a helmet with hair support in accordance with the present invention.
Figure 6:
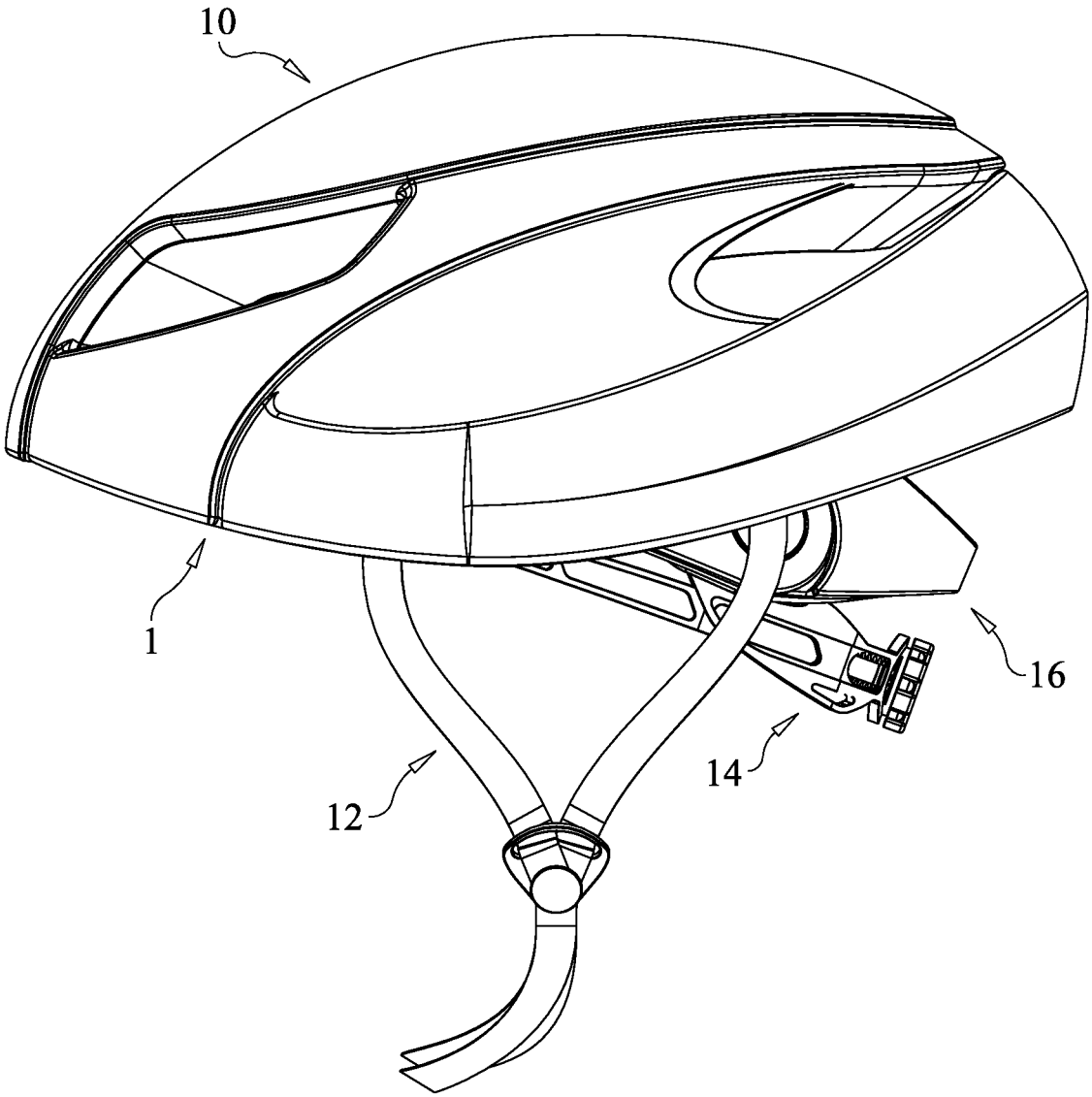
FIG. 6 is a left side view of a helmet with hair support in accordance with the present invention.
Figure 7:
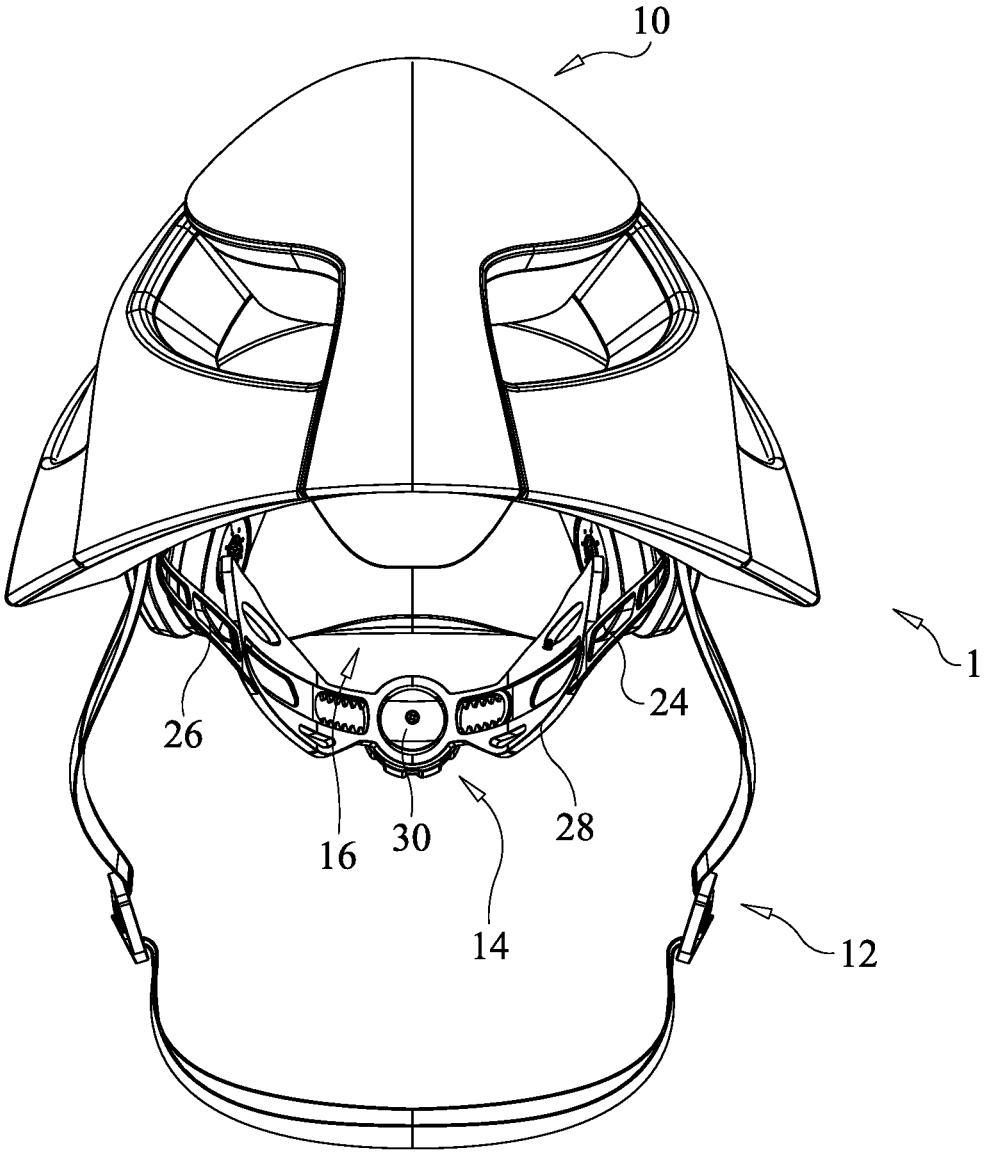
FIG. 7 is a front view of a helmet with hair support in accordance with the present invention.
Figure 8:
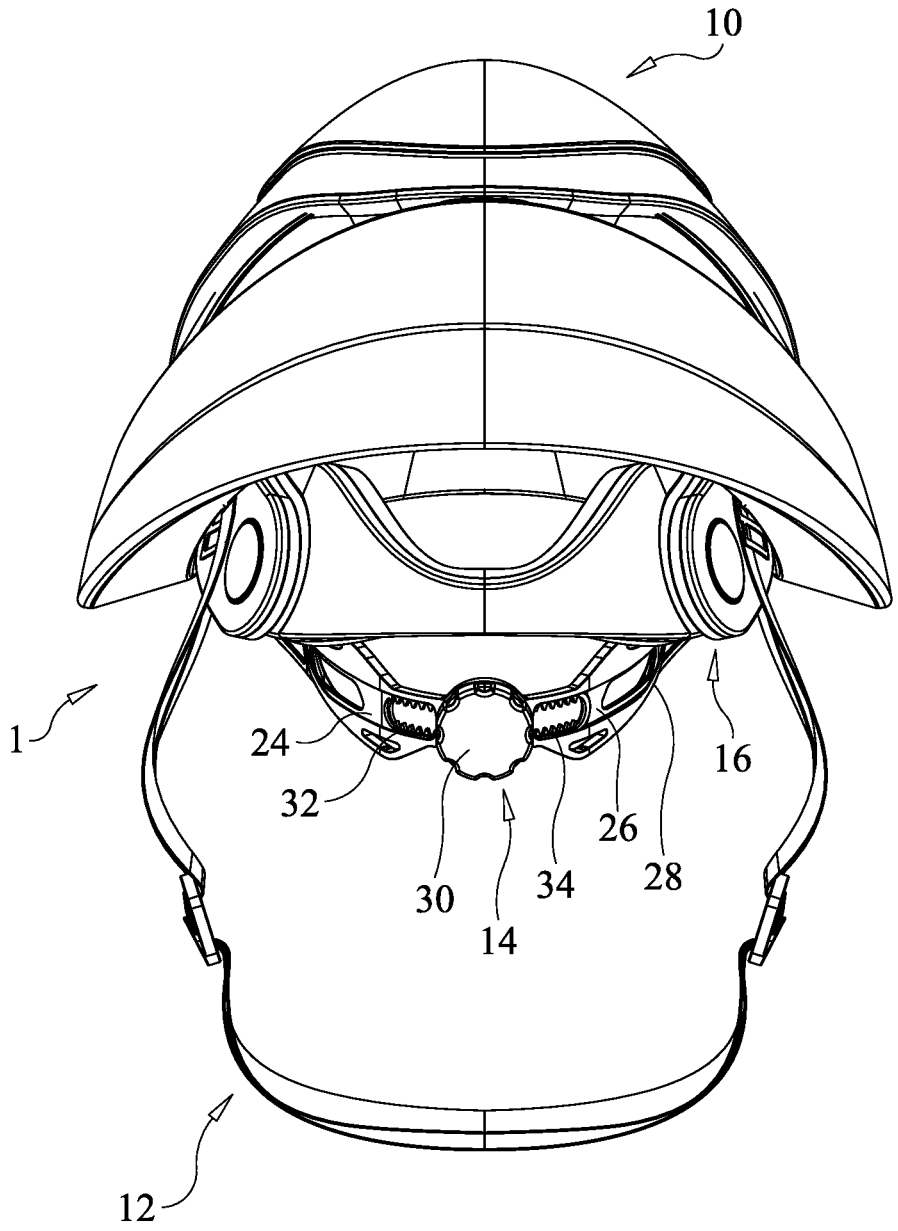
FIG. 8 is a rear view of a helmet with hair support in accordance with the present invention.

With reference now to the drawings, and particularly to FIG. 1, there is shown a top perspective view of a helmet with hair support 1. With reference to FIGS. 2-8, the helmet with hair support 1 preferably includes a helmet portion 10, an adjustable chin strap 12, an adjustable head mechanism 14 and an adjustable hair support 16. The helmet portion 10 preferably includes an outer shell 18, an inner shell 20 and a helmet foam insert 22. The foam helmet insert 22 is retained between the inner and outer shells 18, 20 with a bonding substance or the like. One end of the adjustable chin strap 12 is sized to receive a user chin opposing ends of the chin strap 12 are secured to opposing sides of an inside rim surface of the helmet portion 10. Adjustable chin straps are well known in the art and need not be explained in further detail. The adjustable head mechanism 14 includes a left head strap 24, a right head strap 26, a head strap base 28 and a head ratchet mechanism 30. The head strap base 28 includes a ratchet opening (not shown) for receiving the head ratchet mechanism 30. One end of the left head strap 24 includes a left rachet loop 32 and one end of the right head strap 26 includes a right ratchet loop 34. The ratchet mechanism 30 is inserted through the left ratchet loop, the right ratchet loop 34 and the ratchet opening. The ratchet mechanism 30 is retained in the ratchet opening. Opposing ends of the left and right head straps 26, 28 are secured to opposing sides of the inside rim surface of the helmet portion 10.

Figure 9:
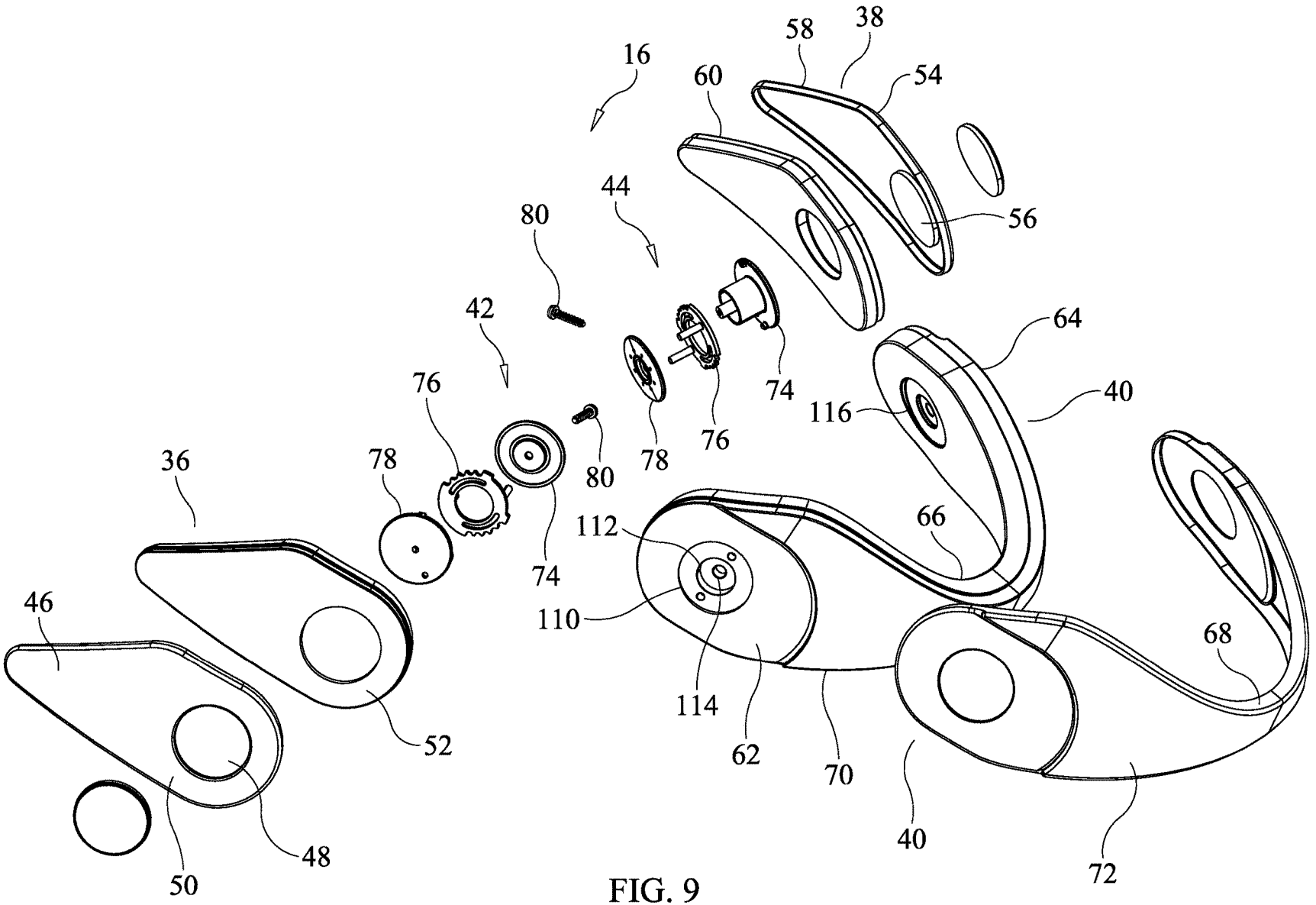
FIG. 9 is an exploded perspective view of an adjustable hair support of a helmet with hair support in accordance with the present invention.

With reference to FIG. 9, the adjustable hair support 16 preferably includes a left pivot base 36, a right pivot base 38, a hair support bar 40, a left pivoting ratchet mechanism 42 and a right pivoting ratchet mechanism 44. One end of the left pivot base 36 includes a left attachment surface 46 and an opposing end includes a left pivot hole 48. The left pivot base 36 preferably includes a left outer plate 50 and a left foam support 52. One end of the right pivot base 38 includes a right attachment surface 54 and an opposing end includes a right pivot hole 56. The right pivot base 38 preferably includes a right outer plate 60 and a right foam layer 60. The hair support bar 40 has a substantial U-shape. The hair support bar 40 preferably includes a left pivot ear 62, a right pivot ear 64 and a hair support base 66. A hair clearance depression 68 is formed in a top and middle of the hair support base 66. The hair support bar 40 preferably includes a support foam base 70 and a support cover 72. The ratchet mechanism 30 allows the hair support bar 40 to be indexed to different angles relative to the helmet portion 10.

Figure 10:
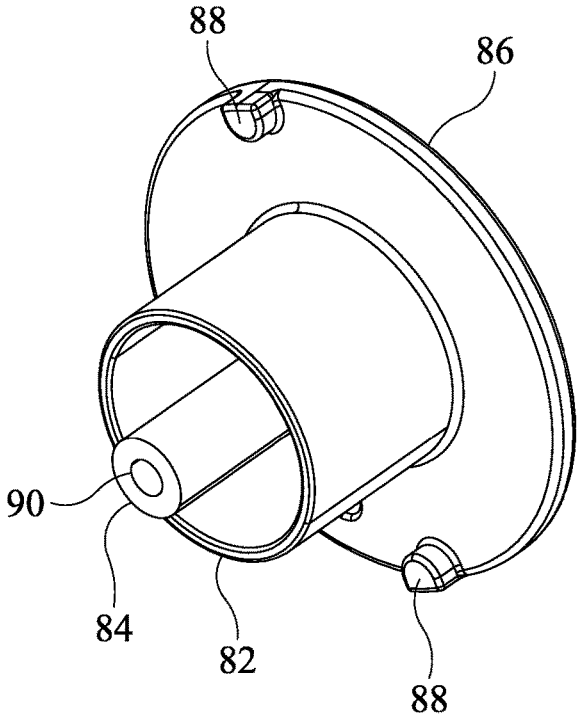
FIG. 10 is a perspective view of a base ratchet member of an adjustable hair support of a helmet with hair support in accordance with the present invention.
Figure 11:
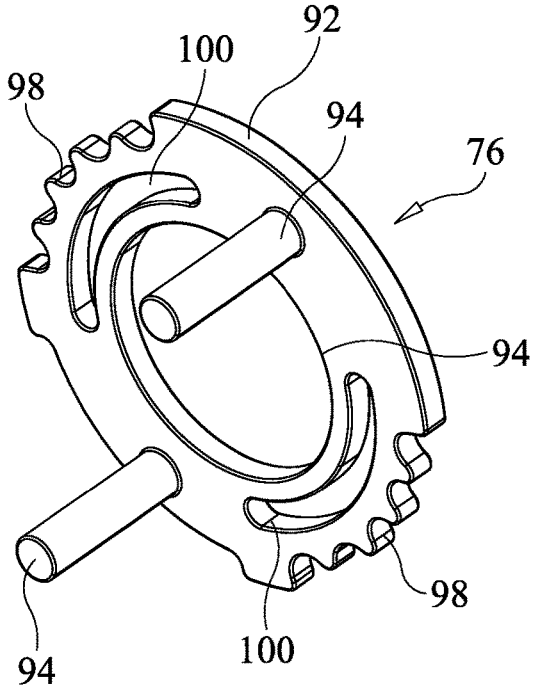
FIG. 11 is a perspective view of a support ratchet member of an adjustable hair support of a helmet with hair support in accordance with the present invention.
Figure 12:
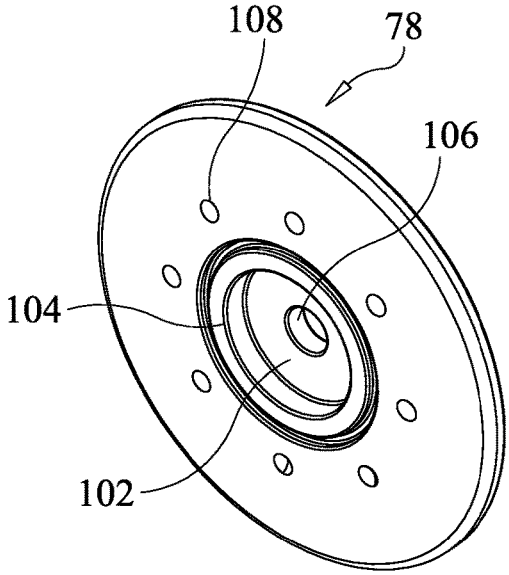
FIG. 12 is a perspective view of an anchor plate of a support ratchet member of an adjustable hair support of a helmet with hair support in accordance with the present invention.

With reference to FIGS. 10-12, the left and right ratchet mechanisms 42, 44 each include a base ratchet member 74, a support ratchet member 76, an anchor plate 78 and a fastener 80. The base ratchet member 74 preferably includes a tubular projection 82, a fastener pole 84 and a base plate 86. The tubular projection 82 extends outward from a front of the base plate 86. A pair of ratchet projections 88 extend from opposing ends and outward from the front of the base plate 86. The fastener pole 84 is concentric with the tubular projection 82 and extends outward from the front of the base plate 86. A hole 90 is formed in the fastener pole 84 to receive the fastener 80, which is preferably self-tapping screw.

The support ratchet member 76 preferably includes a support base plate 92 and two pin projections 94. The two pin projections 94 extend outward from opposing ends and a front the support base plate 92. A center hole 96 is formed through the base plate 92. A pair of ratchet teeth 98 are formed on opposing ends of the support base plate 92 and perpendicular to the two pin projections 94. A curved opening 100 is formed through the support base plate 92 and behind each set of ratchet teeth 98. The ratchet teeth 98 are sized to receive one of the pair of ratchet projections 88 of the base ratchet member 74. The curved opening 100 is formed behind each set of ratchet teeth 98 to allow the set of ratchet teeth 98 to deflect inward into the support base plate 92 to allow the support ratchet member 76 to be rotated relative to the left pivot base 36 or the right pivot base 38. The anchor plate 78 includes a pin boss 102 that extends from a rear thereof. A pin bore 104 is formed in a rear of the pin boss 102 to provide clearance for the fastener pole 84. A fastener hole 106 is formed through the pin boss 102 to receive the fastener 80. A plurality of cavities 108 are preferably formed around the pin bore 104.

The helmet with hair support 1 is preferably assembled in the following manner. The outer shell 18 is attached to a top of the foam helmet insert 22 and the inner shell 20 is attached to a bottom of the foam helmet insert 22 by applying a bonding agent or the like to form the helmet portion 10. Opposing ends of the chin strap 12 are secured to opposing sides of the inside rim of the helmet portion 10. Opposing ends of the left and right head straps 24, 26 of the adjustable head mechanism 14 are secured to opposing sides of the inside rim of the helmet portion 10. The left attachment surface 46 of the left pivot base 36 is attached to a left side of the inside rim of the helmet portion 10 with a bonding substance or the like. The right attachment surface 54 of the right pivot base 38 is attached to a right side of the inside rim of the helmet portion 10 with a bonding substance or the like.

With reference to FIG. 9, a support bore 110 is formed in the left and right pivot ears 62, 64 to receive the support base plate 92 of the support ratchet member 76. A tube bore 112 is formed in the left and right pivot ears 62, 64 to receive the tubular projection 82 of the left and right support ratchet members 42, 44. A pole hole 114 is formed through a bottom of the tube bore 112 to receive the fastener pole 84 of the left and support ratchet members 62, 46. An anchor bore 116 is formed in an inside surface of the left and right pivot ears 62, 64 to receive the anchor plate 78.

The left and right base ratchet members 74 and the left and right support ratchet members 76 are inserted into the right and left pivot ears. The anchor plates 78 are inserted into the left and right anchor bores 116. The base ratchet member 74 is inserted into the left pivot hole 48 of the left pivot base 36. The base ratchet member 74 is secured to the left pivot base 36. The base ratchet member 74 is inserted into the right pivot hole 56 of the right pivot base 38. The base ratchet member 74 is secured to the right pivot base 38. A fastener 80 is inserted through the anchor plate 78 and threaded into the fastener pole 84 of the base rachet member 74. The hair support bar 66 may be angularly adjusted relative to a bottom of the helmet rim of the helmet portion 10.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An adjustable rear hair support for attachment to an inside rim of a helmet, comprising:

an adjustable hair support includes a left pivot base, a right pivot base, a hair support bar and at least one pivoting ratchet mechanism, said left pivot base is configured to be secured to a left side of said inside rim, said right pivot base is configured to be secured to a right side of said inside rim, one end of said hair support bar is pivotally engaged with said left pivot base and the other end of said hair support bar is pivotally engaged with said right pivot base, wherein said hair support bar is configured to be indexed at multiple angles utilizing said at least one pivoting ratchet mechanism.

2. The adjustable rear hair support of claim 1, wherein:

said pivoting ratchet mechanism includes a base ratchet member, a support ratchet member, an anchor plate and a fastener.

3. The adjustable rear hair support of claim 2, wherein:

said base ratchet member includes a tubular projection, a fastener pole and a base plate, said tubular projection extends outward from a front of said base plate, a pair of ratchet projections extend from opposing ends and outward from said front of the base plate, said fastener pole extends outward from the front of said base plate.

4. The adjustable rear hair support of claim 3, wherein:

said anchor plate includes a pin boss extending from a rear thereof, a pin bore is formed in a rear of said pin boss to provide clearance for said fastener pole.

5. The adjustable rear hair support of claim 3, wherein:

a hole is formed through at least one of said left and right pivot bases to receive said base ratchet member.

6. The adjustable rear hair support of claim 2, wherein:

said support ratchet member includes a support base plate and two pin projections, said two pin projections extend outward from opposing ends and a front of said support base plate, a pair of ratchet teeth are formed on opposing ends of said support base plate.

7. A helmet with adjustable rear hair support, comprising:

a helmet portion includes an inner rim surface;

an adjustable chin strap includes a chin end, a left strap and a right strap, said left and right straps are attached to said inner rim surface;

an adjustable head mechanism includes a head end, a left head strap, a right head strap and a head ratchet mechanism, said left and right head straps are attached to said inner rim surface; and an adjustable hair support includes a left pivot base, a right pivot base, a hair support bar and at least one pivoting ratchet mechanism, said left pivot base is secured to a left side of said inner rim surface, said right pivot base is secured to a right side of said inner rim surface, one end of said hair support bar is pivotally engaged with said left pivot base and the other end of said hair support bar is pivotally engaged with said right pivot base, wherein said hair support bar is configured to be indexed at multiple angles utilizing said at least one pivoting ratchet mechanism.

8. The helmet with adjustable rear hair support of claim 7, wherein:

said pivoting ratchet mechanism includes a base ratchet member, a support ratchet member, an anchor plate and a fastener.

9. The helmet with adjustable rear hair support of claim 8, wherein:

said base ratchet member includes a tubular projection, a fastener pole and a base plate, said tubular projection extends outward from a front of said base plate, a pair of ratchet projections extend from opposing ends and outward from said front of the base plate, said fastener pole extends outward from the front of said base plate.

10. The helmet with adjustable rear hair support of claim 9, wherein:

said anchor plate includes a pin boss extending from a rear thereof, a pin bore is formed in a rear of said pin boss to provide clearance for said fastener pole.

11. The helmet with adjustable rear hair support of claim 9, wherein:

a hole is formed through at least one of said left and right pivot bases to receive said base ratchet member.

12. The helmet with adjustable rear hair support of claim 8, wherein:

said support ratchet member includes a support base plate and two pin projections, said two pin projections extend outward from opposing ends and a front of said support base plate, a pair of ratchet teeth are formed on opposing ends of said support base plate.

13. The helmet with adjustable rear hair support of claim 7, wherein:

a hair clearance depression is formed in a top and middle of a hair support base.

* * * * *